US011346370B2

(12) United States Patent
Liu et al.

(10) Patent No.: US 11,346,370 B2
(45) Date of Patent: May 31, 2022

(54) JET STRUCTURE OF FAN ROTOR

(71) Applicant: ASIA VITAL COMPONENTS CO., LTD., New Taipei (TW)

(72) Inventors: Wen-Hao Liu, New Taipei (TW); Yu-Tzu Chen, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 82 days.

(21) Appl. No.: 16/842,711

(22) Filed: Apr. 7, 2020

(65) Prior Publication Data

US 2021/0310500 A1 Oct. 7, 2021

(51) Int. Cl.

| | |
|---|---|
| ***F04D 29/66*** | (2006.01) |
| ***F04D 19/00*** | (2006.01) |
| *F04D 29/58* | (2006.01) |

(52) U.S. Cl.

CPC ..... *F04D 29/666* (2013.01); *F04D 19/002* (2013.01); *F04D 29/667* (2013.01); *F04D 29/5833* (2013.01); *F05B 2210/30* (2013.01)

(58) Field of Classification Search

CPC .... F04D 29/666; F04D 29/667; F04D 29/682; F04D 29/684; F04D 19/002

See application file for complete search history.

(56) References Cited

U.S. PATENT DOCUMENTS

| | | | | |
|---|---|---|---|---|
| 7,626,295 | B2 | 12/2009 | Yamaguchi | |
| 8,678,785 | B2 * | 3/2014 | Nogami | F04D 25/0613 417/410.1 |
| 2008/0014095 | A1 | 1/2008 | Moniz et al. | |
| 2016/0290346 | A1 * | 10/2016 | Watanabe | F04D 29/5806 |

FOREIGN PATENT DOCUMENTS

| | | | |
|---|---|---|---|
| CN | 1769716 | A | 5/2006 |
| CN | 102536898 | A | 7/2012 |
| CN | 102906429 | A | 1/2013 |
| CN | 103597215 | A | 2/2014 |
| CN | 105736426 | A | 7/2016 |

(Continued)

OTHER PUBLICATIONS

Search Report dated Dec. 15, 2020 issued by Taiwan Intellectual Property Office for counterpart application No. 109109014.

(Continued)

*Primary Examiner* — Sabbir Hasan

(74) *Attorney, Agent, or Firm* — Bradley J. Thorson; DeWitt LLP

(57) ABSTRACT

The present invention relates to a jet structure of a fan rotor, which comprises a fan wheel and at least one connecting channel. The fan wheel has a hub and plural blades disposed on the circumferential side of the hub. The hub has a top portion and a sidewall. Each of the blades has an upper surface and a lower surface which form a high-pressure zone and a low-pressure zone, respectively. The connecting channel is provided with at least one first inlet disposed in the high-pressure zone and at least one first outlet disposed in the low-pressure zone. The first inlet and the first outlet are a first end and a second end of the connecting channel, respectively. By means of the design of the present invention, the effect of noise reduction can be achieved.

2 Claims, 16 Drawing Sheets

(56) References Cited

FOREIGN PATENT DOCUMENTS

| | | | |
|---|---|---|---|
| CN | 108412816 | A | 8/2018 |
| CN | 212106354 | U | 12/2020 |
| EP | 0521285 | A1 | 1/1993 |
| JP | S55112898 | A | 9/1980 |
| JP | S5844297 | A | 3/1983 |
| JP | 11230092 | A | 8/1999 |
| TW | M595694 | | 5/2020 |

OTHER PUBLICATIONS

Search Report dated Nov. 6, 2020 issued by China National Intellectual Property Administration for counterpart application No. 2020101931203.

Search Report dated Jul. 6, 2021 issued by China National Intellectual Property Administration for counterpart application No. 2020101931203.

* cited by examiner

JET STRUCTURE OF FAN ROTOR

BACKGROUND OF THE INVENTION

1. Field of the Invention

The present invention relates to a jet structure of a fan rotor and, in particular, to a jet structure of a fan rotor, which can achieve the effect of noise reduction.

2. Description of Prior Art

With the improvements on 5G, AI, and IOT technologies, the computation loads and the amount of data transmission of the telecommunication equipment increase enormously and thus more powerful cooling capacity inside such equipment is required to keep it in normal operating condition. The method of increasing cooling capacity inside the telecommunication equipment is to increase the number of fans, the rotational speed of fans or to modify the design of fans. However, the high-performance fan with improved air flow and pressure always cause louder noise. How to reduce the noise and improve the cooling capacity of fans is always a big challenge for the designers in the industry.

The current method of noise reduction is mainly to design a specific structure placed where eddies occur on the blade or to add extra energy (e.g., a nozzle device) to destroy the eddies to reduce noise. As for the method of addition of extra energy, the air is directed from the frame wall to the blade tip to destroy the eddies to achieve noise reduction.

The prior art uses a fluid source and plural nozzles for generating swirls, which is called active jet method. That is, the nozzles are added on the frame wall of the fan to provide the swirl directed to the blades tips to mitigate the eddies. However, this method incurs another problem; that is, the extra nozzles and external driving power are required, which is not feasible to place a nozzle device in a confined space (e.g., inside a server or communication equipment). Also, the use of the extra nozzle equipment obviously increases the cost. Moreover, as for the traditional method of swirl generation in which the fan structure is equipped with a rotating part (i.e., a rotor), the connecting tube of the nozzle air source cannot be implemented on the rotating part. Thus, the outlet of the nozzle can only be placed on the frame wall or the non-rotating part to generate swirls. As a result, the noise reduction method by generating swirls is restricted by the arrangement of the nozzle itself and thus the extent and effect of noise reduction are limited.

SUMMARY OF THE INVENTION

One objective of the present invention is to provide a jet structure of a fan rotor to achieve the effect of noise reduction.

Another objective of the present invention is to provide a jet structure of a fan rotor, which directs the air flow around the fan rotor to naturally generate jets to restrict the eddies at the fan blades and reduce the cost through a jet structure itself.

To achieve the above objectives, the present invention provides a jet structure of a fan rotor, which comprises a fan wheel and at least one connecting channel. The fan wheel has a hub and a plurality of blades disposed on the circumferential side of the hub. The hub has a top portion and a sidewall axially extending from the edge of the top portion. Each of the blades has an upper surface and a lower surface which form a high-pressure zone and a low-pressure zone, respectively. The connecting channel is provided with at least one first inlet disposed in the high-pressure zone and at least one first outlet disposed in the low-pressure zone; the first inlet and the first outlet are a first end and a second end of the connecting channel, respectively. By means of the present invention, the self-jet generated by the fan rotor can restrict the eddies around the blades to effectively achieve the effects of noise reduction and cost reduction.

DETAILED DESCRIPTION OF THE INVENTION

The above objective, structural and functional characteristics of the present invention will be described according to the preferred embodiments with the accompanying figures.

Figure 1A:
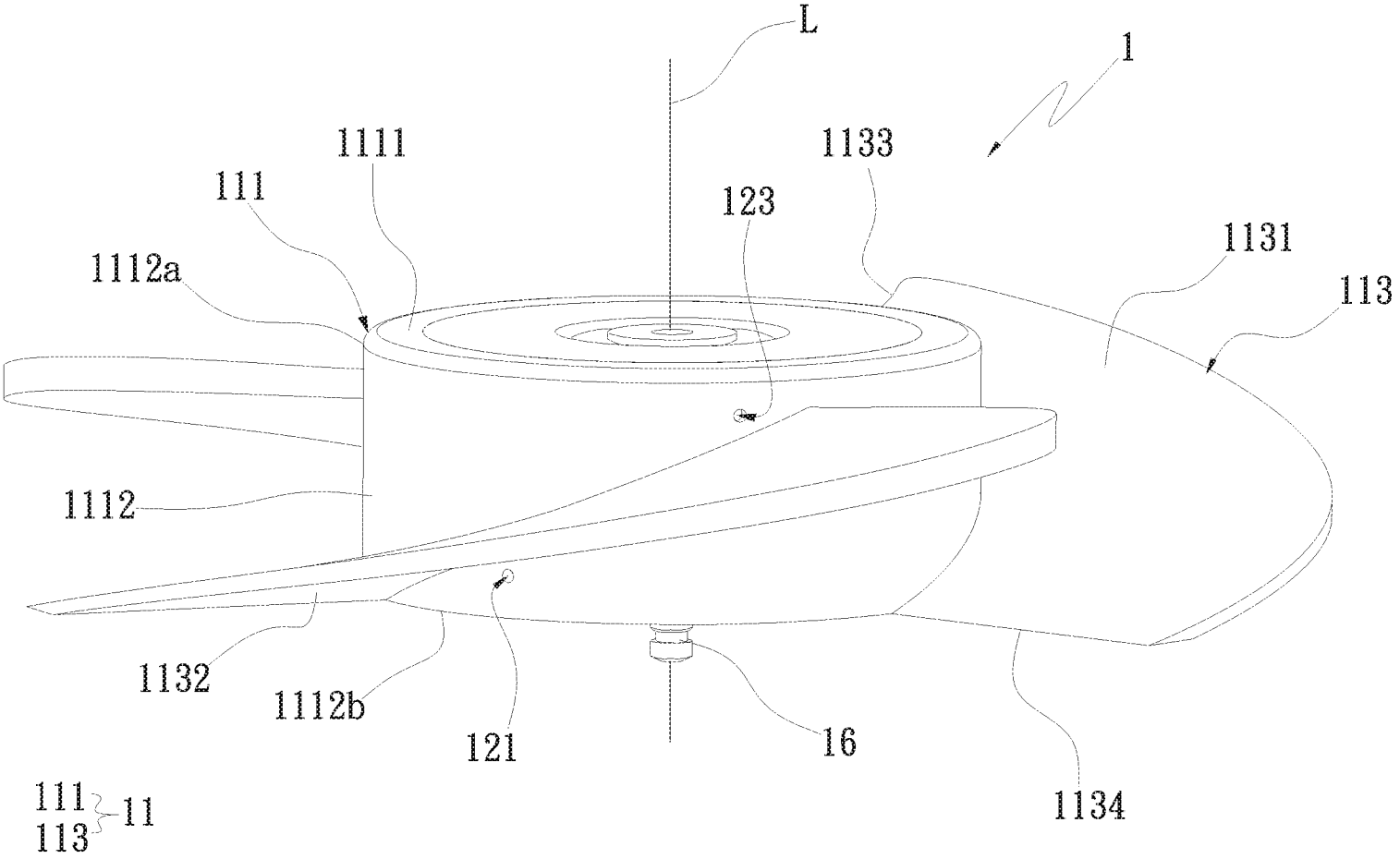
FIG. 1A is a perspective view of the jet structure of a fan rotor according to the first embodiment of the present invention.
Figure 1B:
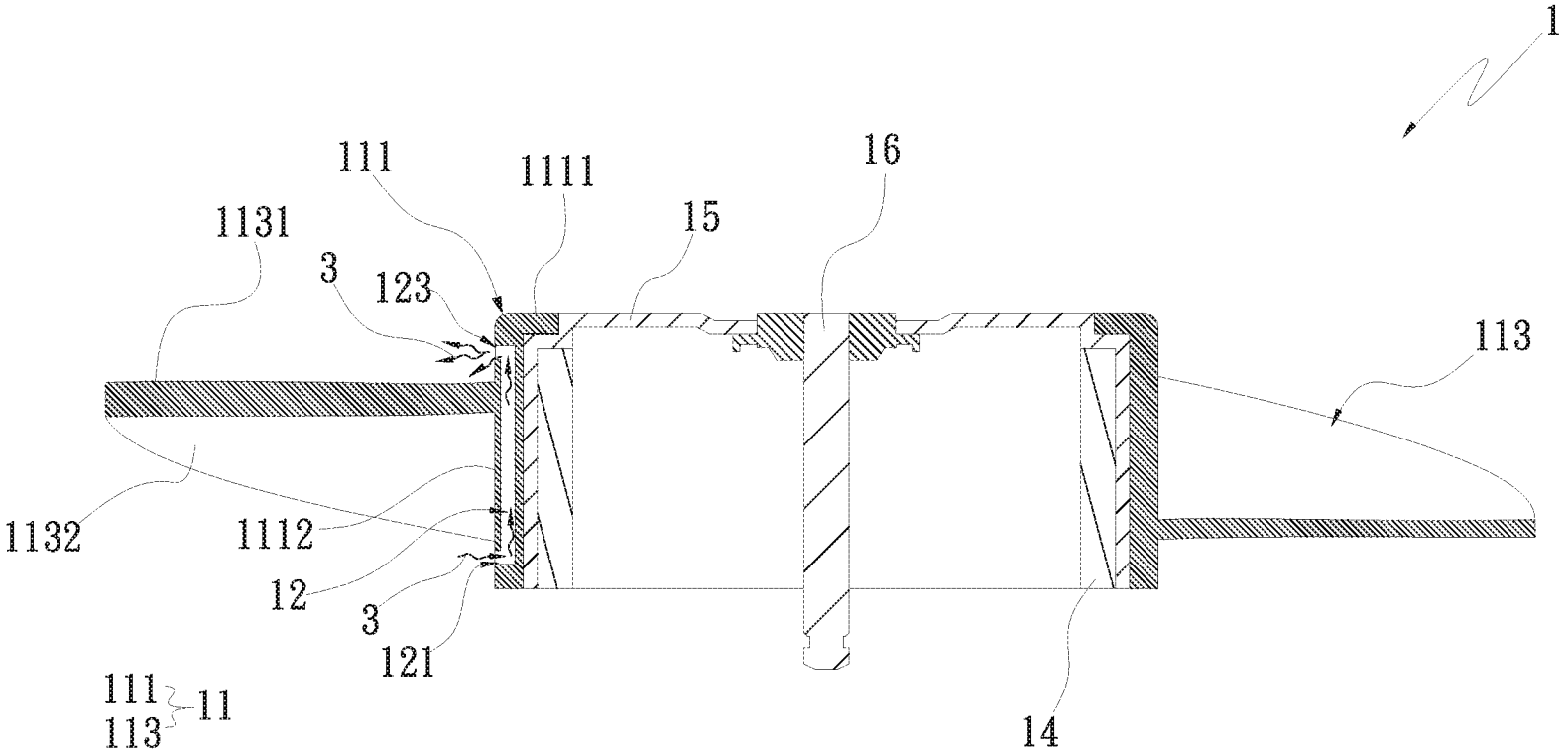
FIG. 1B is a cross-sectional view of the jet structure of a fan rotor according to the first embodiment of the present invention.
Figure 1C:
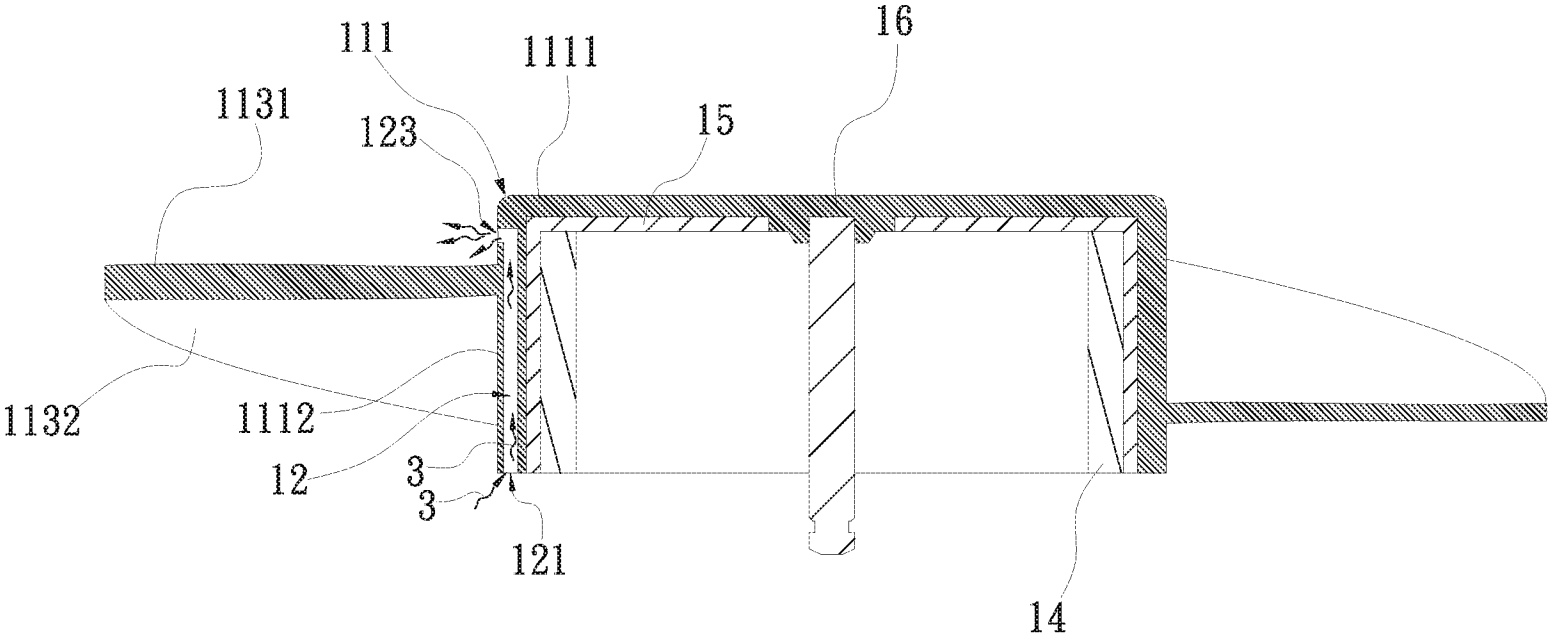
FIG. 1C is a cross-sectional view of the jet structure of a fan rotor according to a variant of the first embodiment of the present invention.
Figure 2A:
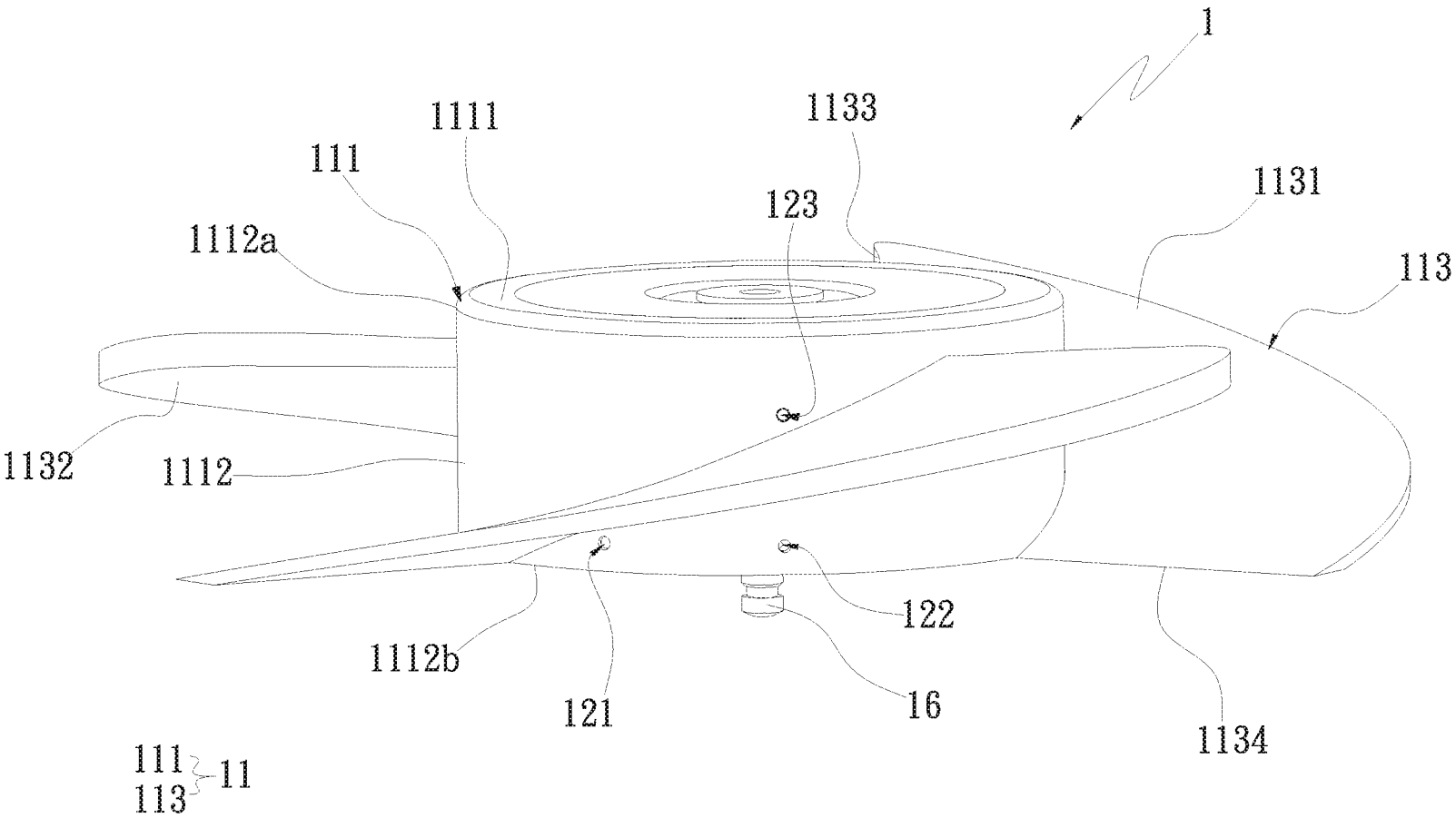
FIG. 2A is a perspective view of the jet structure of a fan rotor according to another variant of the first embodiment of the present invention.
Figure 2B:
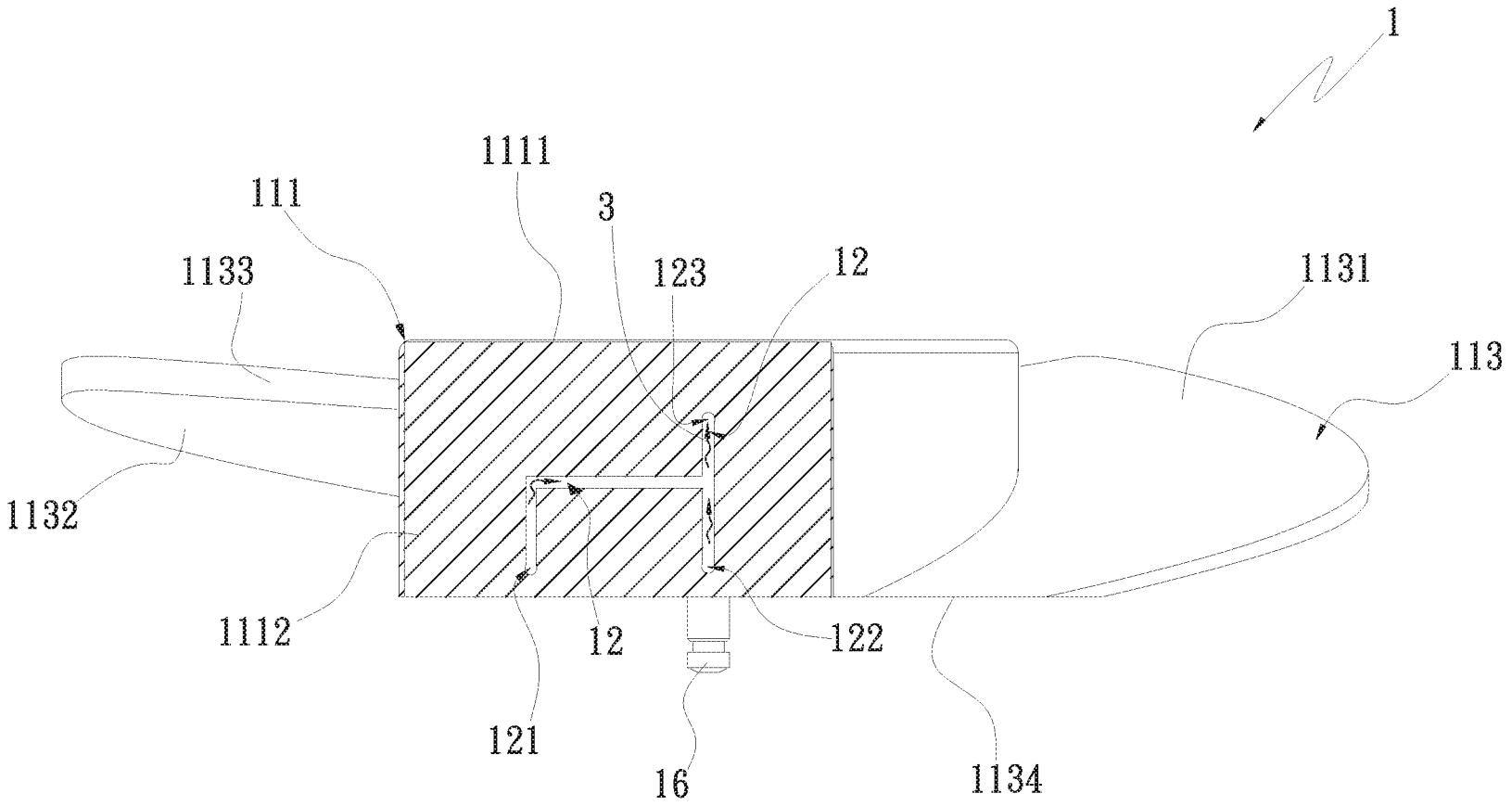
FIG. 2B is a cross-sectional view of the jet structure of a fan rotor according to another variant of the first embodiment of the present invention.
Figure 3A:
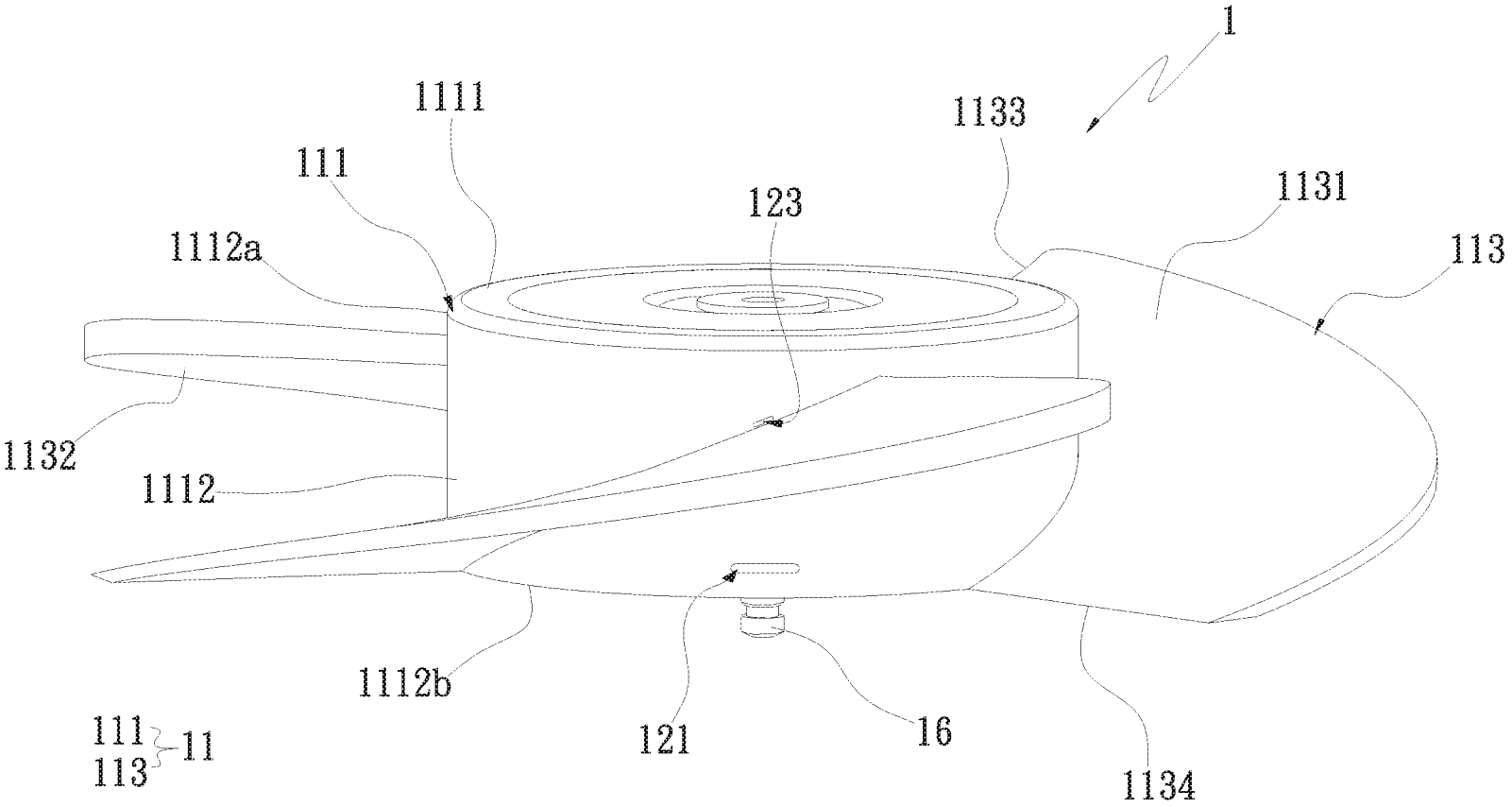
FIG. 3A is a perspective view of the jet structure of a fan rotor according to yet another variant of the first embodiment of the present invention.
Figure 3B:
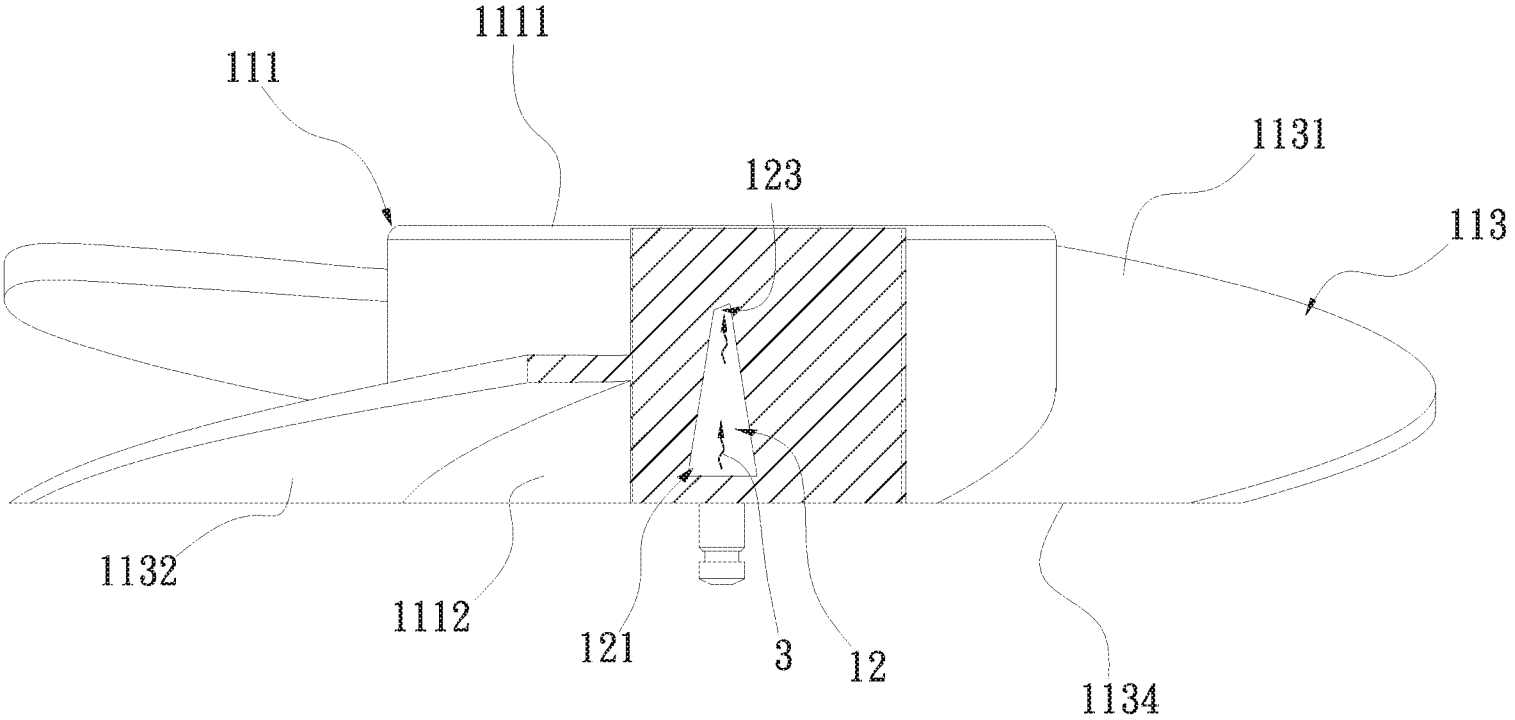
FIG. 3B is a cross-sectional view of the jet structure of a fan rotor according to yet another variant of the first embodiment of the present invention.
Figure 4A:
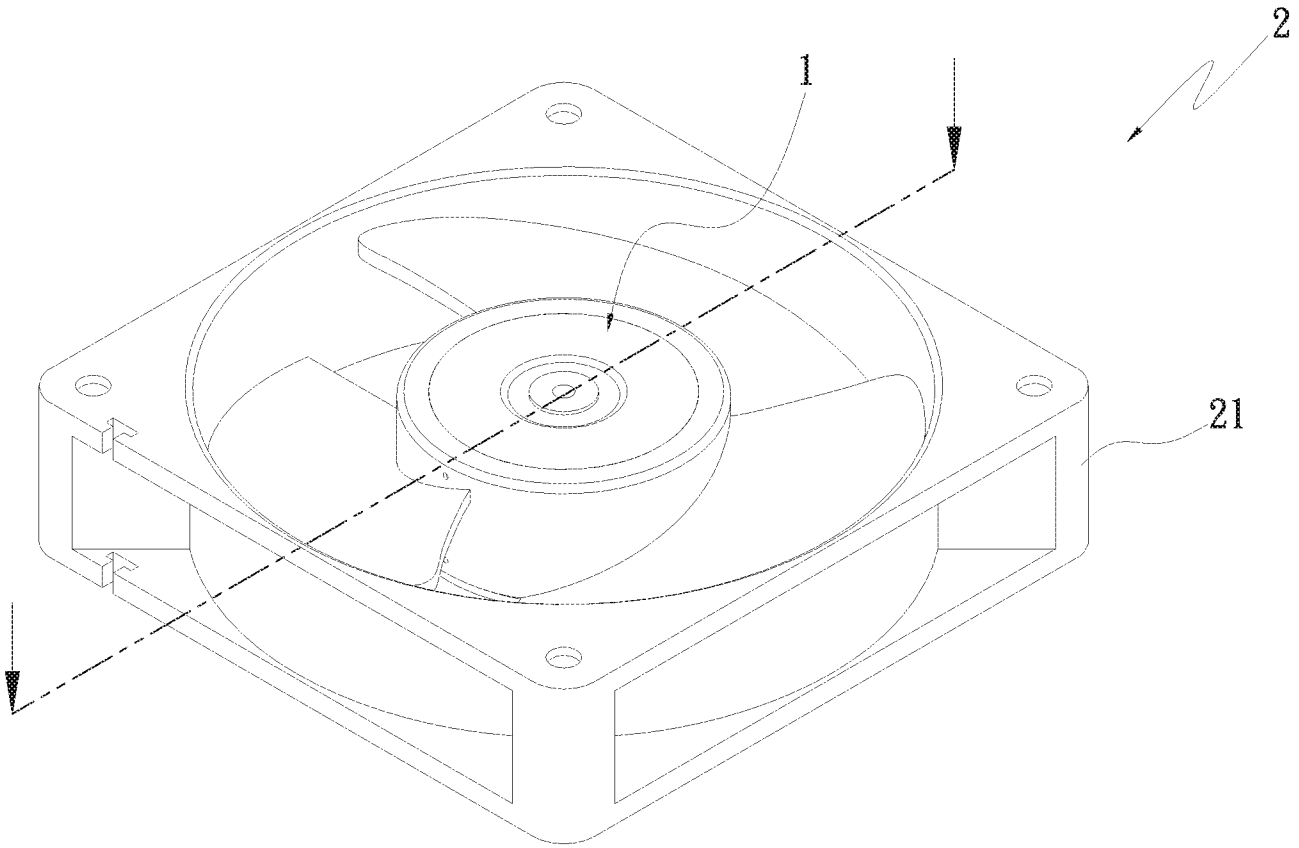
FIG. 4A is a schematic view of the assembled fan according to the first embodiment of the present invention.
Figure 4B:
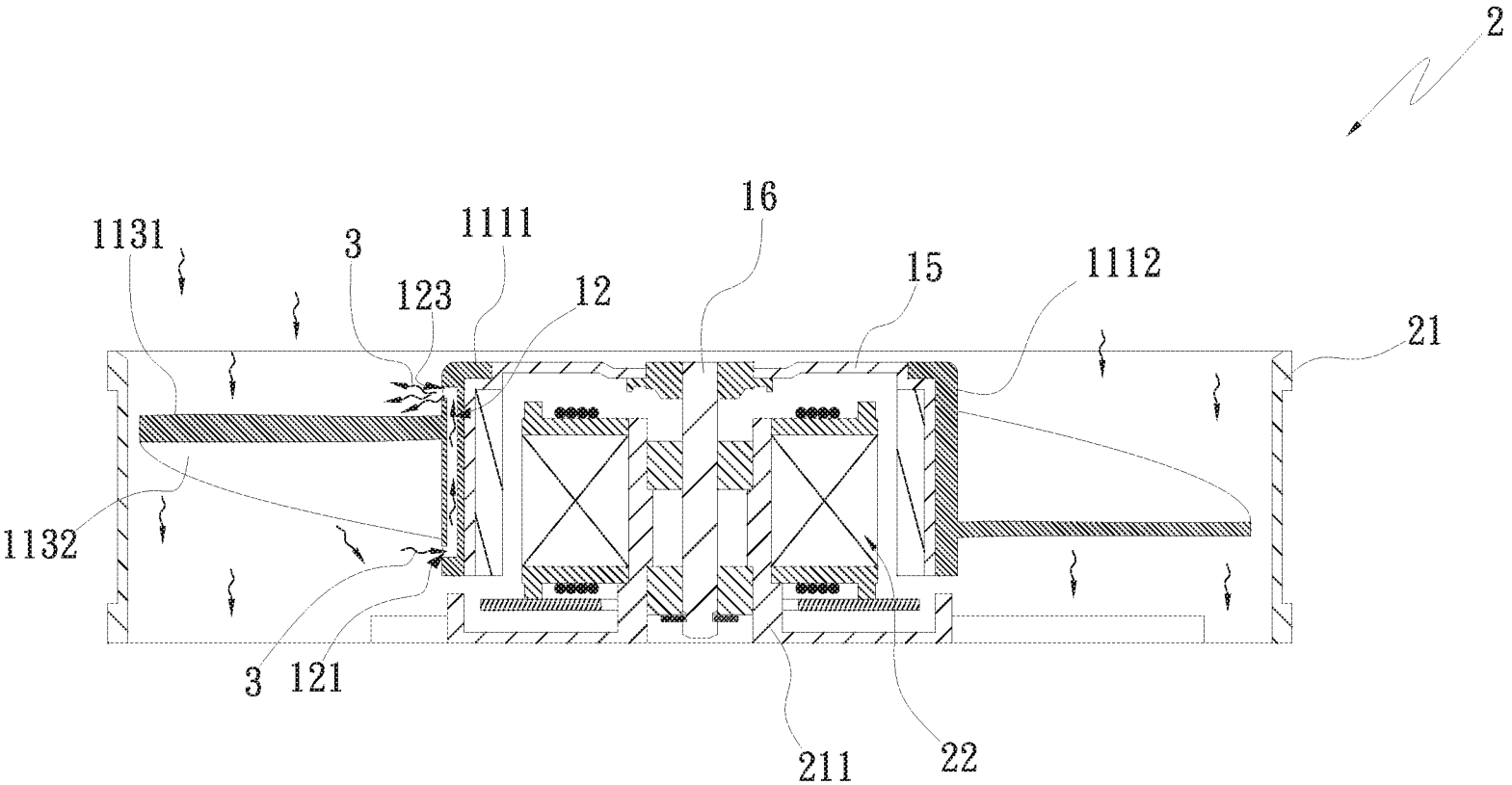
FIG. 4B is an assembled cross-sectional view of the assembled fan according to the first embodiment of the present invention.

The present invention relates to a jet structure of a fan rotor. Please refer to FIG. 1A is a perspective view of the jet structure of a fan rotor according to the first embodiment of the present invention, FIG. 1B is a cross-sectional view of the jet structure of a fan rotor according to the first embodiment of the present invention, FIG. 1C is a cross-sectional view of the jet structure of a fan rotor according to a variant of the first embodiment of the present invention, FIG. 2A is a perspective view of the jet structure of a fan rotor according to another variant of the first embodiment of the present invention, FIG. 2B is a cross-sectional view of the jet structure of a fan rotor according to another variant of the first embodiment of the present invention, FIG. 3A is a perspective view of the jet structure of a fan rotor according to yet another variant of the first embodiment of the present invention, FIG. 3B is a cross-sectional view of the jet structure of a fan rotor according to yet another variant of the first embodiment of the present invention, FIG. 4A is a schematic view of the assembled fan according to the first embodiment of the present invention, and FIG. 4B is an assembled cross-sectional view of the assembled fan according to the first embodiment of the present invention. As shown in FIGS. 1A, 1B, 4A, and 4B, the jet structure 1 of the fan rotor is applied to a fan 2 (e.g., a centrifugal fan, axial fan, frameless fan, or tandem fan). The jet structure 1 of the fan rotor of the present invention is installed in the frame 21 of an axial fan 2. The jet structure 1 of the fan rotor comprises a fan wheel 11, at least one connecting channel 12, a magnet member 14, a yoke 15 (e.g., an iron shell), and a shaft 16. The fan wheel 11 is integrally formed on the circumferential side of the yoke 15 by injection molding. The magnet member 14 such as a magnet is received on the inner side of the circumference of the yoke 15 corresponding to the stator 22 of the fan 2 for magnetic induction. One end of the shaft 16 is fixed to the center of the fan wheel 11 (or the yoke 15) and the other end is pivoted to the shaft seat 211 in the frame 21. In practice, the yoke 15 can be omitted and the magnet member 14 is a Halbach array.

The fan wheel 11 has a hub 111 and a plurality of blades 113 disposed on the circumferential side of the hub 111. The hub 111 has a top portion 1111 and a sidewall 1112 axially extending from the edge of the top portion 1111. Each of the blades 113 has an upper surface 1131, a lower surface 1132, a front edge 1133 corresponding to the top end 1112*a* of the sidewall 1112, and a rear edge 1134 corresponding to the bottom end 1112*b* of the sidewall 1112 in which the upper surface 1131 and the lower surface 1132 of each blade 113 naturally form a low-pressure zone and a high-pressure zone, respectively. The connecting channel 12 is disposed in the hub 111 or the connecting channel 12 extends from the hub 111 to one of the blades 113. In the current embodiment, the connecting channel 12 is disposed in the sidewall 1112 of the hub 111 and does not penetrate into the inner side of the sidewall 1112 (i.e., the side where the sidewall 1112 attached to the yoke 15). In other words, the connecting channel 12 is disposed vertically or obliquely on the sidewall 1112 of the hub 111 corresponding to the corresponding blade 113. In practice, the connecting channel 12 can be disposed axially in the sidewall 1112 of the hub 111, parallel with the axial line L or can be disposed radially in the sidewall 1112 of the hub 111, vertical to the axial line L.

The connecting channel 12 is provided with a first inlet 121, a first end, a second end, and a first outlet 123. The first inlet 121 and the first outlet 123 are the first end and the second end of the connecting channel 12, respectively, and together form a jet structure. The jet structure is used to restrict the eddies generated by the fan rotor (i.e., the eddies generated on the surface of the blade) to achieve the effect of noise reduction. The first outlet 123 is disposed on the sidewall 1112 above the upper surface 1131 of one of the blades 113; the first outlet 123 is disposed in the low-pressure zone above the upper surface 1131 of the corresponding blade 113. In the current embodiment, the first outlet 123 is disposed close to and above the junction of the sidewall 1112 and a side of one of the blades 113 to jet the air flow to restrict the stall flows on the front edge of the hub 111 (the junction of the sidewall 1112 and the corresponding blade 113) to mitigate the stall noise and postpone the stall condition of the blade 113 such that the fan can operate in a condition of higher pressure to enhance the performance of the fan. The first inlet 121 is disposed on the sidewall 1112 below the lower surface 1132 of one of the blades 113; the first inlet 121 is disposed on the hub 111 in the high-pressure zone below the lower surface 1132 of the corresponding blade 113. The first inlet 121 is used to direct the air flow 3 around the hub 111 into the connecting channel 12.

When the fan 2 is operating, the first inlet 121 in the high-pressure zone below the corresponding blade 113 will direct the air flow 3 around the hub 111 naturally into the connecting channel 12. Because of the pressure difference between the first inlet 121 in the high-pressure zone and the first outlet 123 in the low-pressure zone, the air flow 3 in the connecting channel 12 will flow naturally towards the first outlet 123 in the low-pressure zone above the corresponding blade 113. Then, the air flow 3 (or called the jet) is self-jetted from the first outlet 123 to restrict the eddies generated at the junction of the sidewall 1112 and the corresponding blade 113 and generated on the upper surface 1131 of the corresponding blade 113. Therefore, by means of the self-jet of the jet structure, the eddies generated by the blade 113 (or around the corner between the sidewall 1112 and the corresponding blade 113) can be restricted to effectively achieve noise reduction.

In an embodiment, referring to FIG. 1C, the first inlet 121 in the high-pressure zone is disposed at the bottom end 1112*b* of the sidewall 1112 to direct the air flow 3 around the hub 111 into the connecting channel 12. In another embodiment, a second outlet (not shown) is further disposed to communicate with the connecting channel 12 and is the third end of the connecting channel 12. The second outlet is disposed on the sidewall 1112 above the upper surface 1131 of one of the blades 113 and is close to the first outlet 123; also, the second outlet is disposed in the low-pressure zone above the upper surface 1131 of the corresponding blade 113. The first outlet 123, the second outlet, and the first inlet 121 are individually disposed at three ends of the connecting channel 12 and together form the jet structure such that the connecting channel 12 has a Y-liked shape, but not limited to this. Any with plural outlets or with a three-ended shape is embraced by the connecting channel 12 with three ends of the present invention. Through two outlets disposed in the low-pressure zone above the corresponding blade 113, the eddies generated at several locations on the upper surface 1131 of the blade 113 can be effectively restricted by the jets and thus the jetted area can be extended to reduce the noise.

In another embodiment, referring to FIGS. 2A and 2B, a second inlet 122 is disposed to communicate with the connecting channel 12 and is a third end of the connecting channel 12. The second inlet 122 is disposed on the sidewall 1112 below the lower surface 1132 of one of the blades 113 and is close to the first inlet 121. The first outlet 123 is disposed above the middle of one of the blades 113 and is used to restrict the eddies caused by the diverged flow around the corner between the sidewall 1112 and the corresponding blade 113. Besides, the first outlet 123, the first inlet 121, and the second inlet 122 are individually disposed at three ends of the connecting channel 12 and together form the jet structure such that the connecting channel 12 has an h-liked shape, but not limited to this. Therefore, through plural inlets (e.g., two inlets) disposed in the high-pressure zone, the pressure difference between the inlet and the outlets can be effectively increased to further increase the jet flow.

In another embodiment, referring FIGS. 3A and 3B, the first outlet 123 has a shape corresponding to the shape of the upper surface 1131 (i.e., like the curved shape of the upper surface 1131) of one of the blades 113 and is disposed on the sidewall 1112. In the current embodiment, the first outlet 123 and the first inlet 121 have long-bar shapes, but not limited to this. Therefore, through the first outlet 123 having a long-bar shape, the gain of the jet location can be effectively obtained. Moreover, the connecting channel 12 can have a shape of gradual contraction or gradual expansion. The connecting channel 12 gradually contracts (or expands) upwards from the first inlet 121 to the first outlet 123 along the sidewall 1112 of the hub 111, which can expand the area distribution to decrease the friction inside the connecting channel 12 and then to increase the jet flow. In practice, the shape of the connecting channel 12 can be a large area shaped into a slender bar to reduce the friction inside the channel and increase the jet flow.

Moreover, the locations and numbers of the first outlets 123 (or the second outlets) and the first inlets 121 (or the second inlets 122) are not limited to those described in the above-mentioned embodiments. In practice, more than two inlets can be disposed on the sidewall 112 of the hub 111 to increase the inlet pressure; also, the user can adjust the locations and numbers of the first outlets 123 (or the second outlets) according to the expected locations where the eddies are generated on the blades 113 and then are restricted. For example, one or more than two outlets can be disposed on the sidewall 1112 of the hub 111. Alternatively, one or more than two outlets can be disposed on the upper surface 1131 or the side surface of the blade 113. The locations of the above-mentioned first outlets 123 (or the second outlets) will determine the locations where the eddies are generated on the surface of the corresponding blade 113 and then are restricted by the jet flow. Therefore, the effect of noise reduction can be achieved. The shape of each of the first outlet 123, the second outlet, the first inlet 121, the second inlet 122, and the interior of the connecting channel 12 is a geometric shape or an irregular shape; the geometric shape is a long-bar shape, a flat shape, a square shape, a round shape, or a triangular shape. The first outlet 123, the second outlet, the first inlet 121, the second inlet 122, and the interior of the connecting channel 12 may have the same or different shapes.

In an alternative embodiment, the above-mentioned connecting channel 12 is plural in number. The connecting channels 12 are disposed on the sidewall 1112 of the corresponding blades 113 along the edge of the hub 111 axially or radially and are disposed on the sidewall 1112 of the corresponding blades 113 with axial symmetry. In this way, the same eddy noises can be greatly restricted. Besides, the connecting channels 12 can be disposed on the sidewall 1112 of the blades 113 without axial symmetry to restrict different eddy noises. The first outlet 123, the second outlet, the first inlet 121, the second inlet 122, and the interior of the connecting channel 12 for each connecting channel 12 may have the same or different shapes. The first outlet 123, the second outlet, the first inlet 121, the second inlet 122, and the interior of the connecting channel 12 for each connecting channel 12 may have the same or different sizes.

Therefore, by means of the design of the jet structure of the fan rotor of the present invention, the jet outlet (i.e., the first outlet 123) on the sidewall 1112 of the hub 111 rotates with the corresponding blade 113 of the fan wheel 11 such that the jets can be precisely directed to the eddies on the surface of the blade 113 close to the jet outlet to restrict the diverged eddies. In addition, the inertial force of the jets can be enhanced to destroy the eddies and postpone the air flow to stall, which effectively improves the performance and the operating range of the fan and reduces noise. Furthermore, the traditional extra nozzle equipment and complicated structure design are not used in the present invention and only the jet structure inside the fan rotor is used in the present invention to restrict the eddies on the surfaces of the blades 113 to solve the problem of characteristic noise.

Figure 5A:
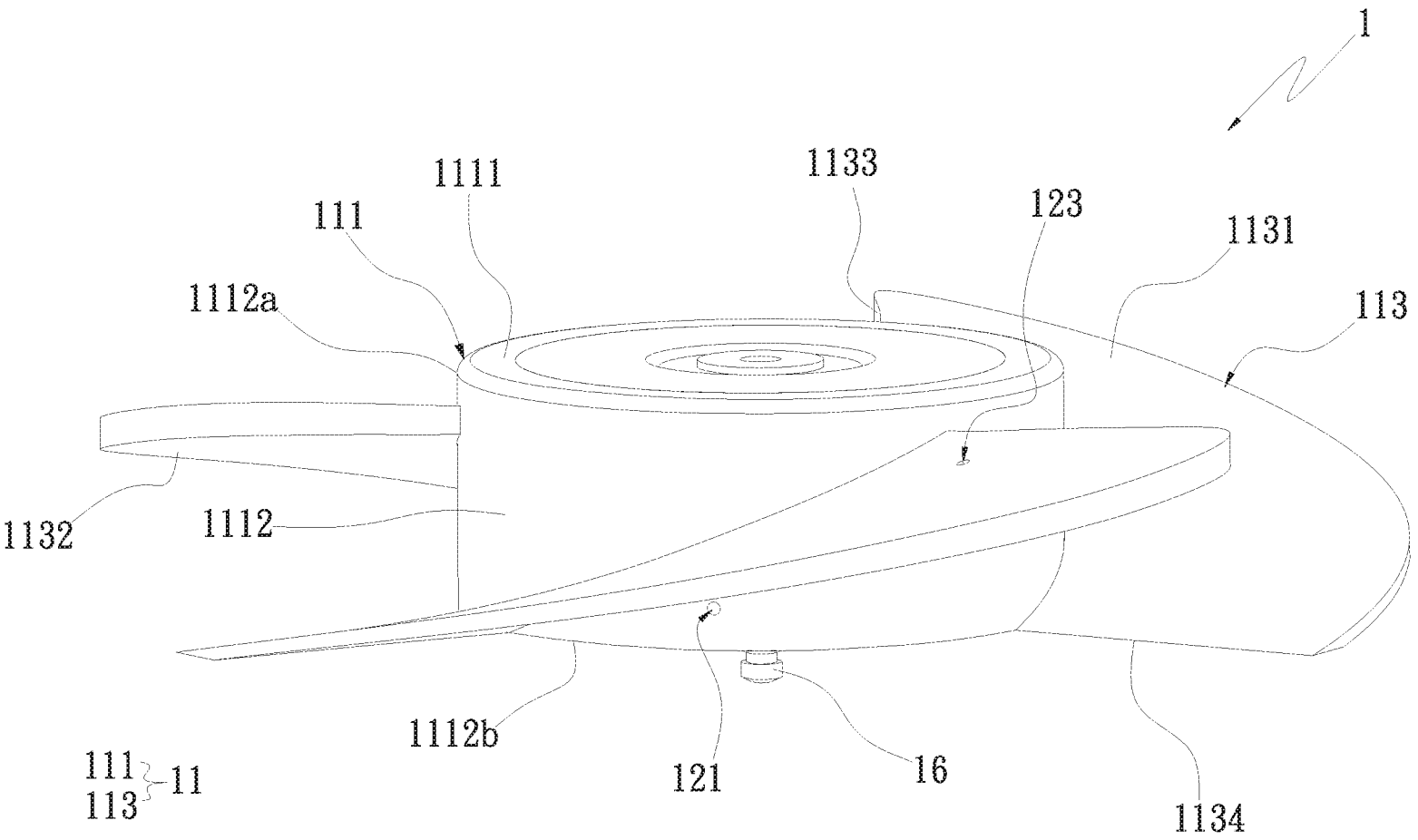
FIG. 5A is a perspective view of the jet structure of a fan rotor according to the second embodiment of the present invention.
Figure 5B:
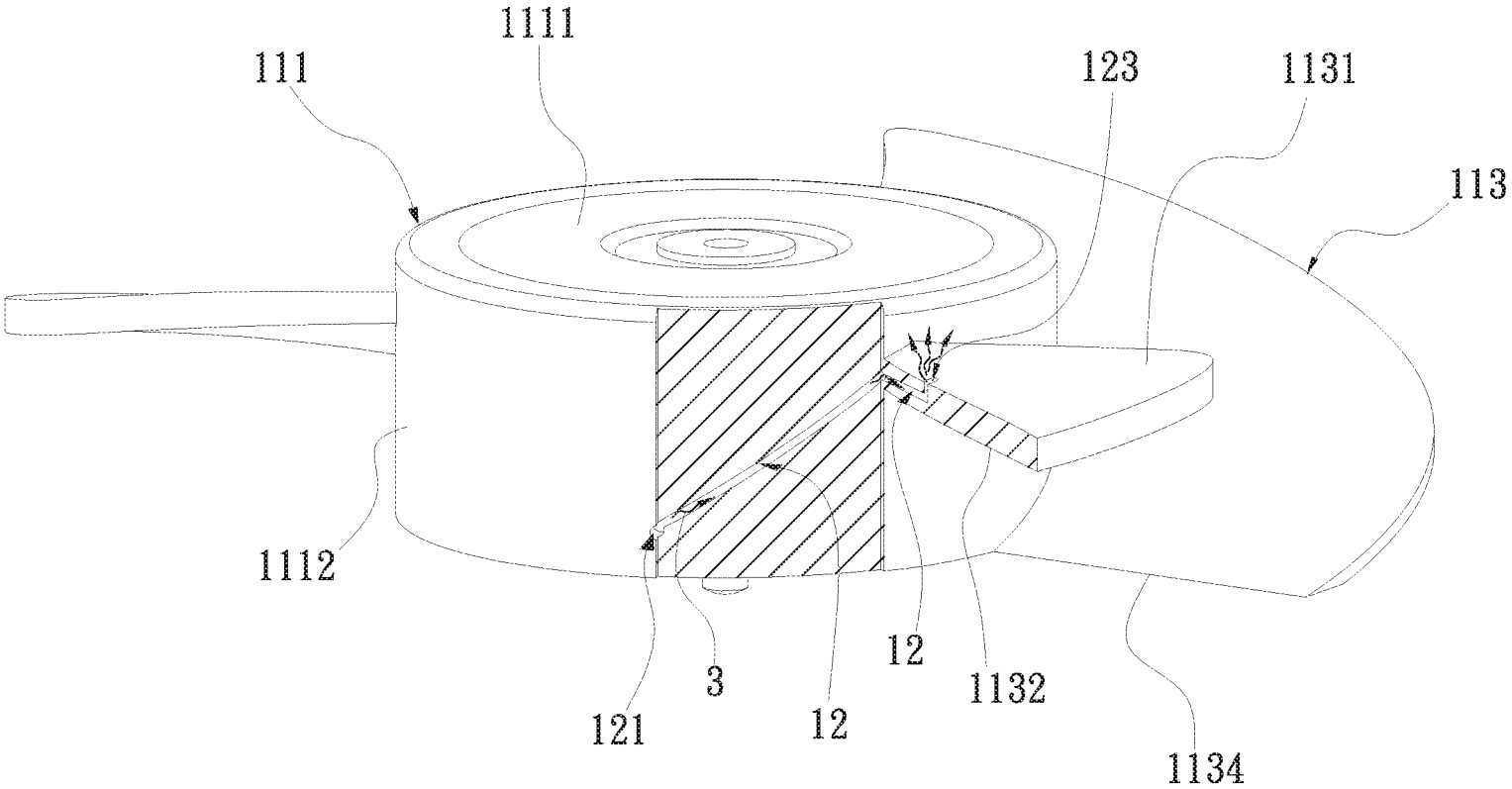
FIG. 5B is a cross-sectional view of the jet structure of a fan rotor according to the second embodiment of the present invention.
Figure 5C:
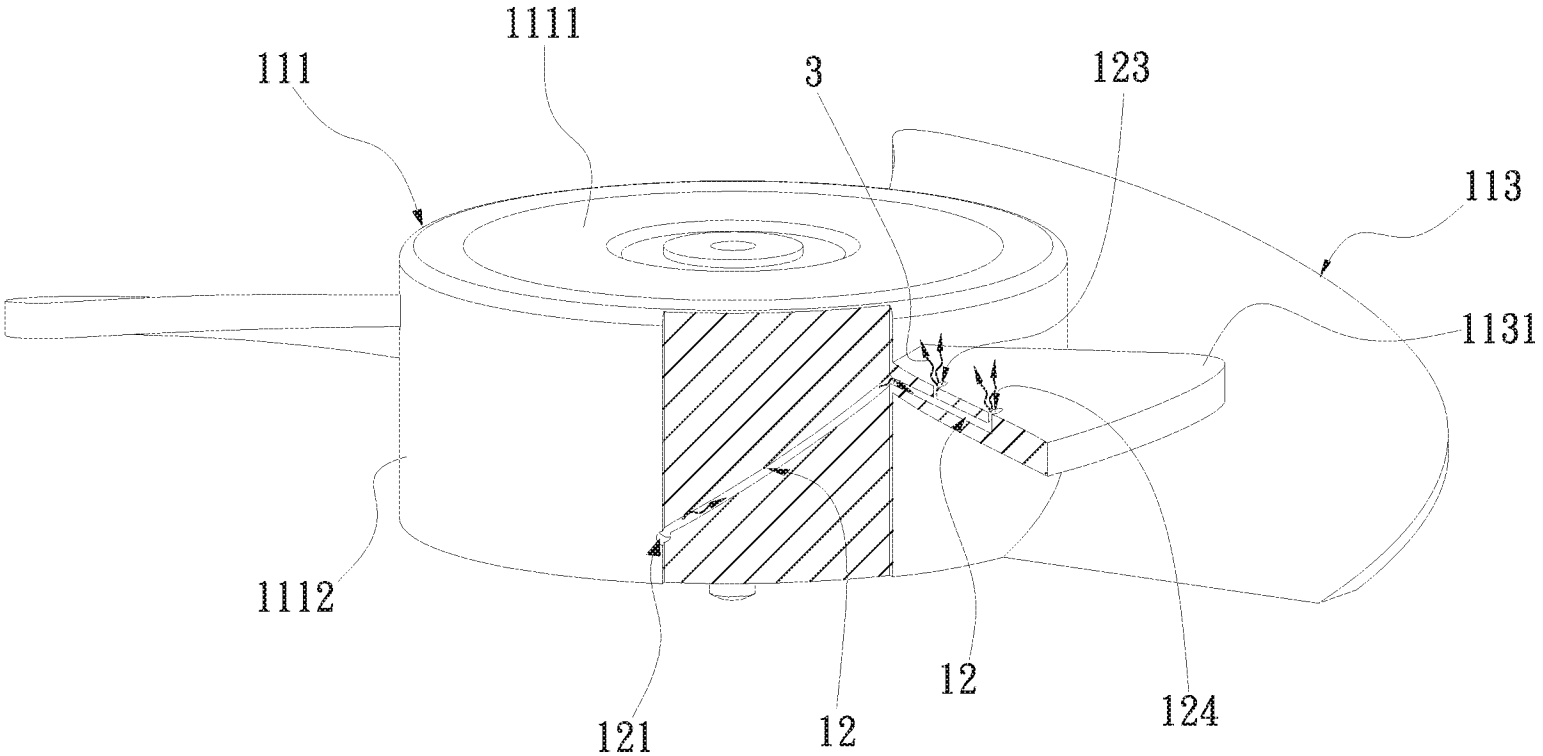
FIG. 5C is a cross-sectional view of the jet structure of a fan rotor according to a variant of the second embodiment of the present invention.
Figure 5D:
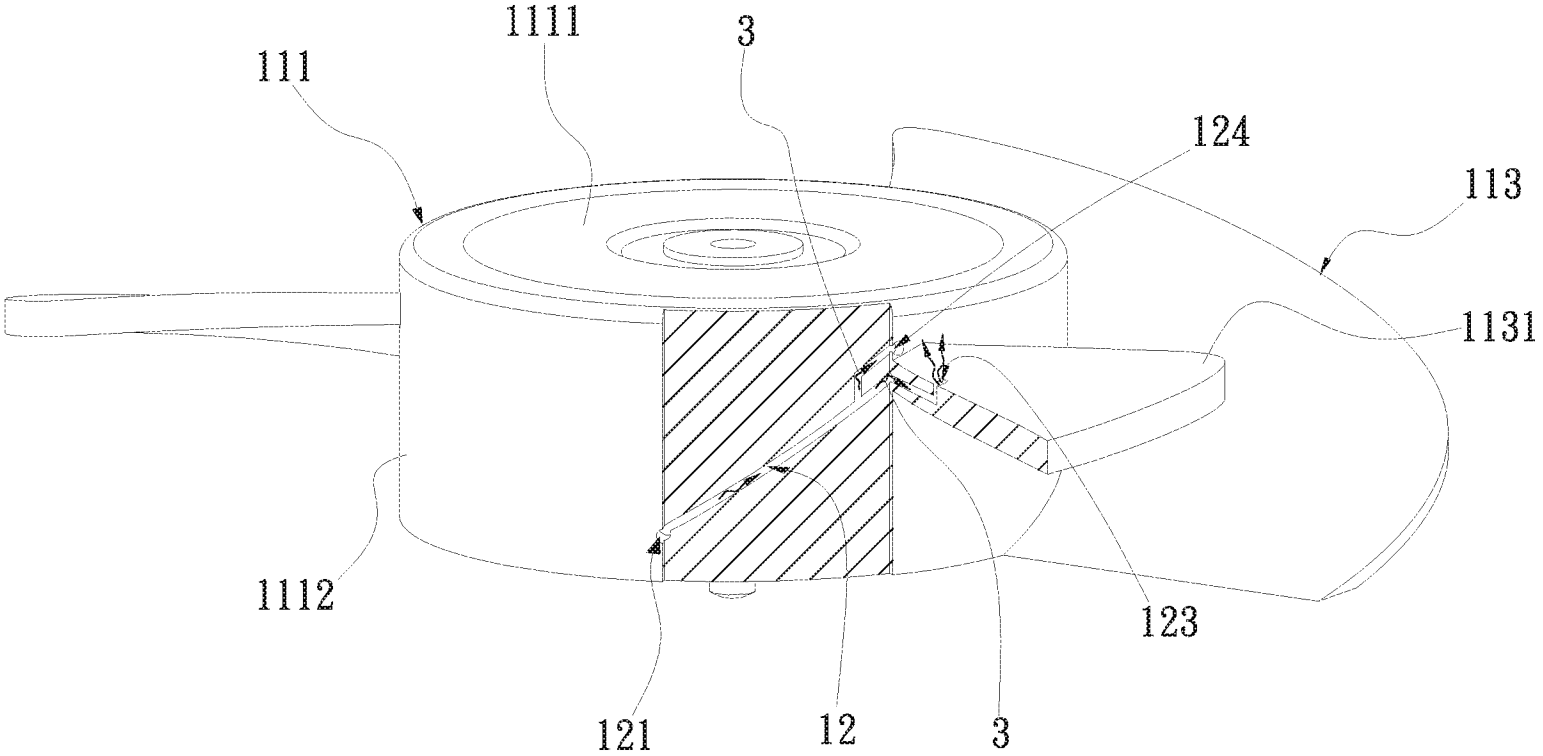
FIG. 5D is a cross-sectional view of the jet structure of a fan rotor according to another variant of the second embodiment of the present invention.
Figure 5E:
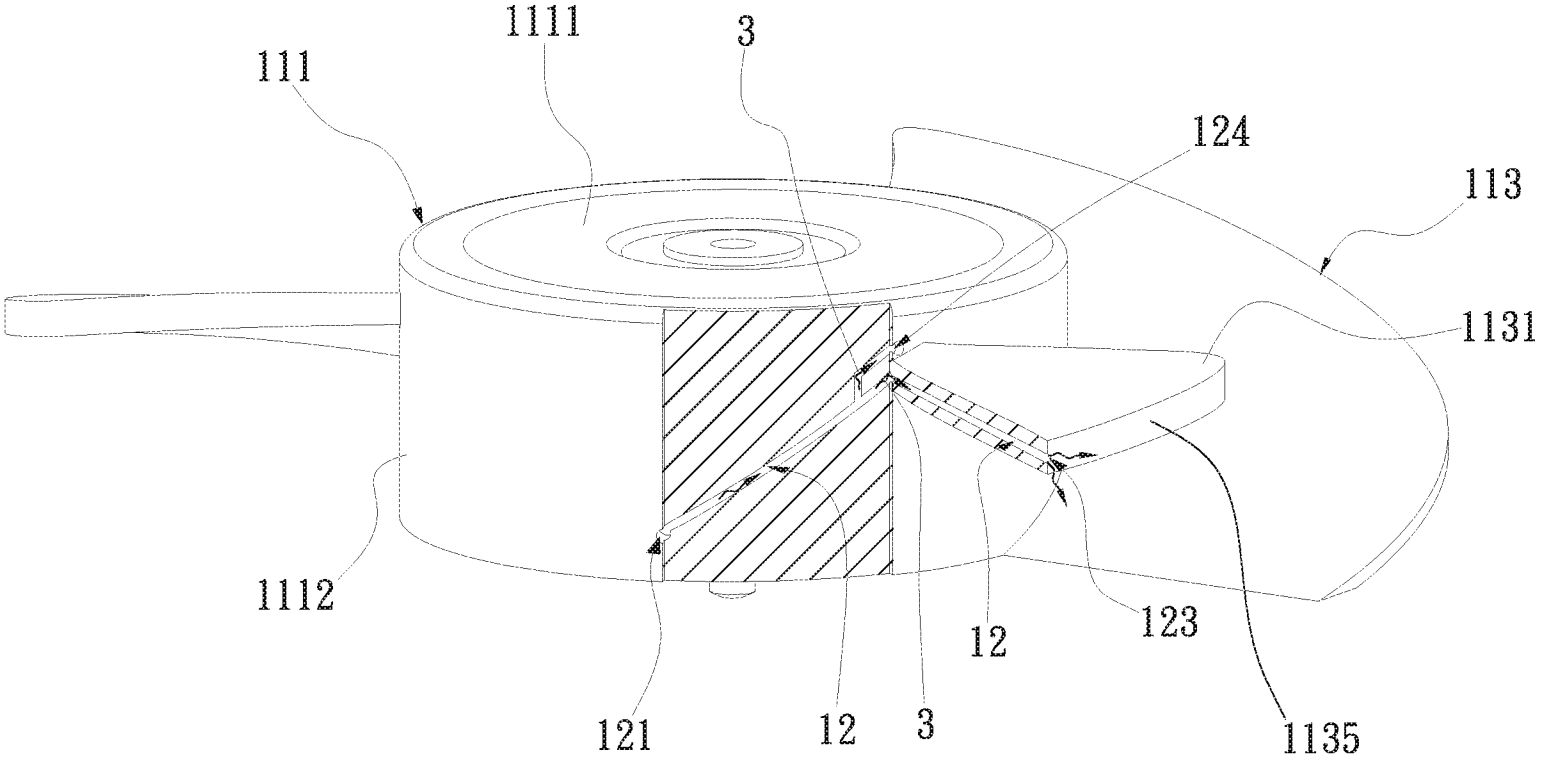
FIG. 5E is a cross-sectional view of the jet structure of a fan rotor according to yet another variant of the second embodiment of the present invention.
Figure 6A:
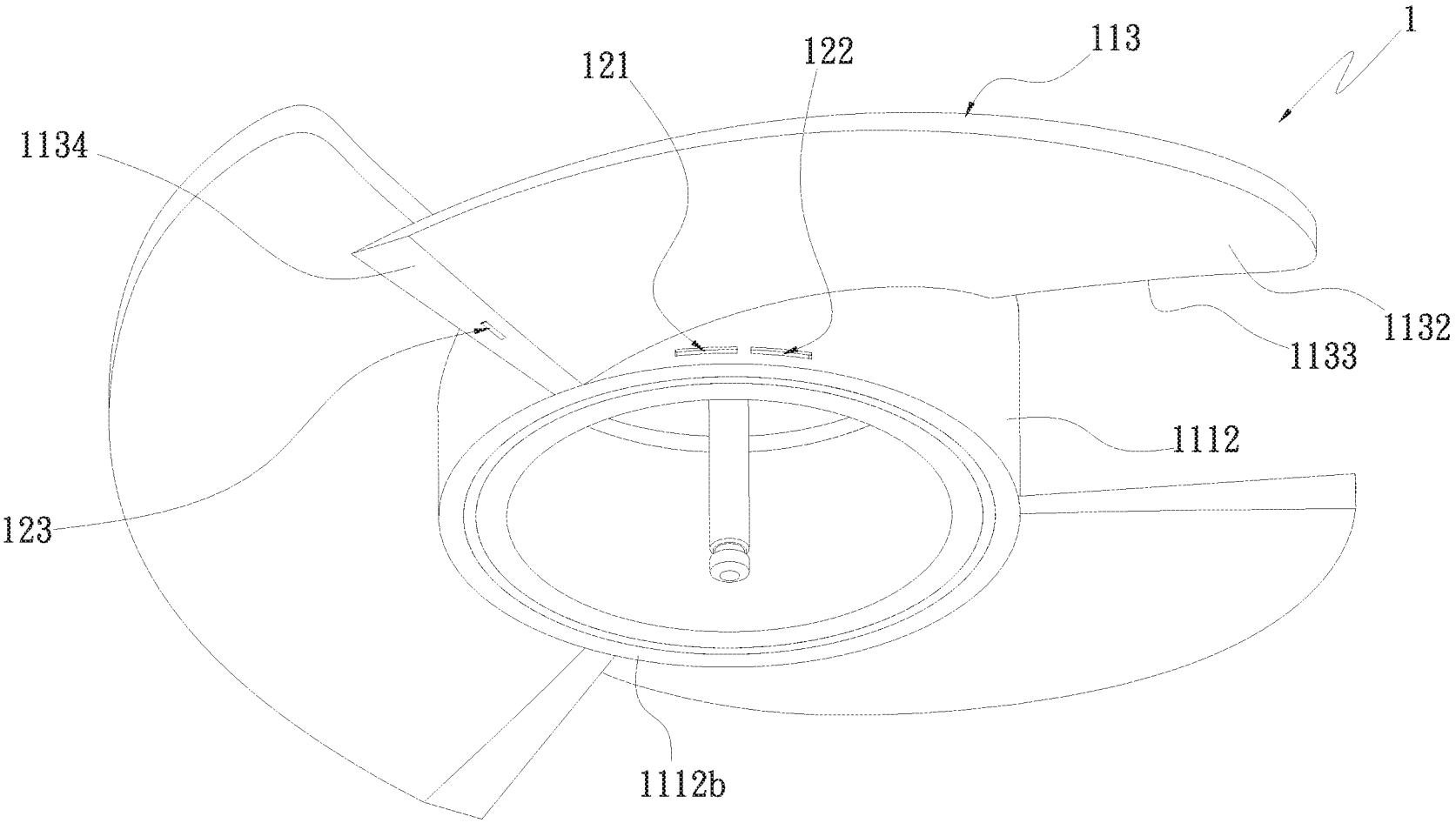
FIG. 6A is a perspective view of the jet structure of a fan rotor according to still another variant of the second embodiment of the present invention.
Figure 6B:
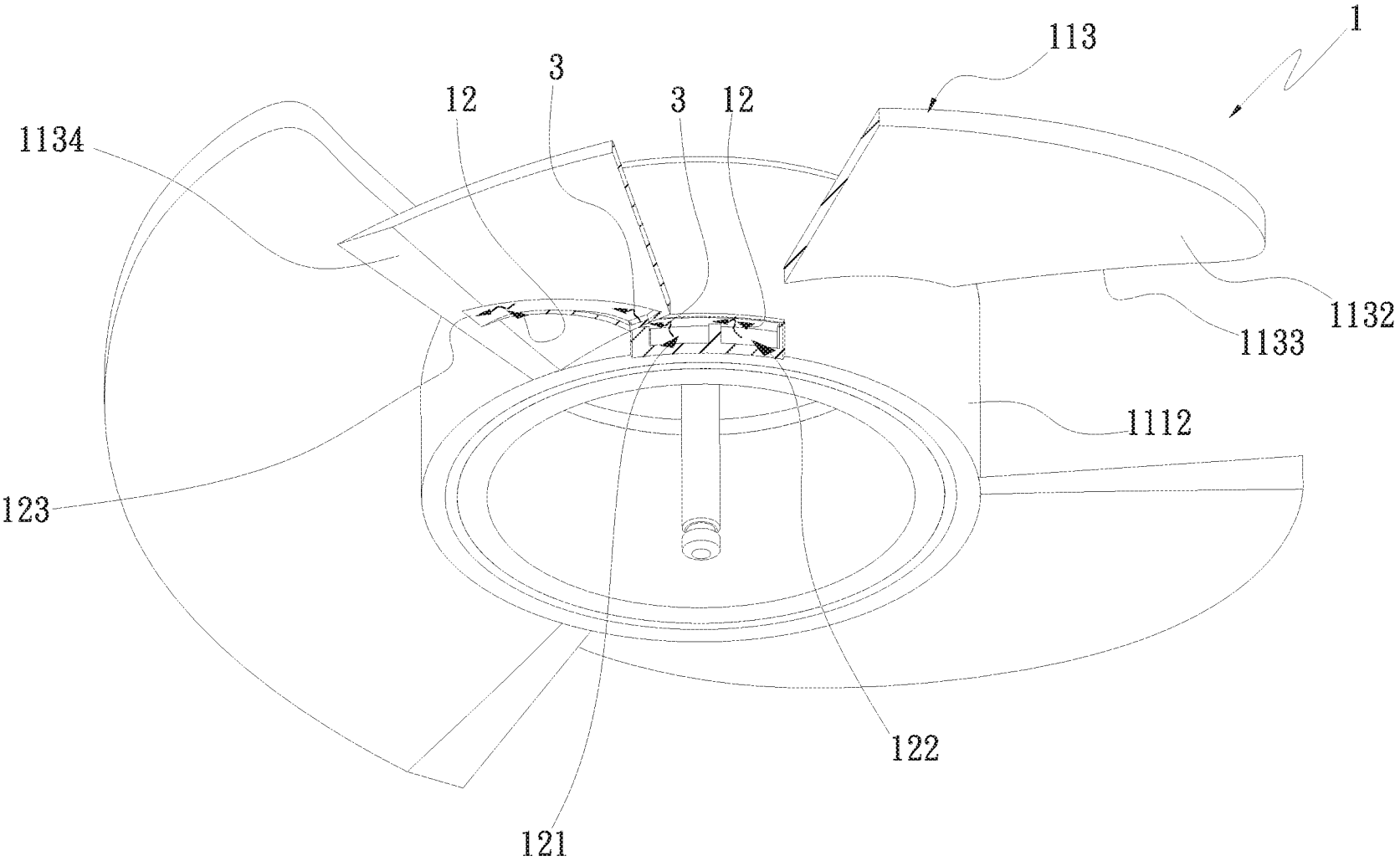
FIG. 6B is a cross-sectional view of the jet structure of a fan rotor according to still another variant of the second embodiment of the present invention.

Please refer to FIG. 5A which is perspective view of the jet structure of a fan rotor according to the second embodiment of the present invention, FIG. 5B which is a cross-sectional view of the jet structure of a fan rotor according to the second embodiment of the present invention, FIG. 5C which is a cross-sectional view of the jet structure of a fan rotor according to a variant of the second embodiment of the present invention, FIG. 5D which is a cross-sectional view of the jet structure of a fan rotor according to another variant of the second embodiment of the present invention, FIG. 5E is a cross-sectional view of the jet structure of a fan rotor according to yet another variant of the second embodiment of the present invention, FIG. 6A which is a perspective view of the jet structure of a fan rotor according to still another variant of the second embodiment of the present invention, and FIG. 6BA which is a cross-sectional view of the jet structure of a fan rotor according to still another variant of the second embodiment of the present invention. As shown in FIGS. 5A and 5B, the jet structure 1 of the fan rotor, the configuration, and the function of the current embodiment are roughly similar to those in the first embodiment and will not be repeated hereinafter. The difference is that in the current embodiment, the connecting channel 12 extends from the hub 111 to one of the blades 113; the first outlet 123 is disposed on an upper surface 1131 of one of the blades 113 and disposed in the low-pressure zone. The first inlet 121 is disposed on the sidewall 1112 below a lower side 1132 of one of the blades 113 and disposed in the high-pressure zone. The connecting channel 12 extends upwards from the first inlet 121 along and inside the sidewall 1112 of the hub 111 to the first outlet 123 on the upper surface 131 of one of the blades 113 through the interior of the one of the blades 113. In this way, by means of the first outlet 123 disposed on the corresponding blade 113, the diverged eddies and the secondary eddies above the surface of the blades 113 can be directly restricted to achieve the effect of noise reduction.

In an embodiment, referring to FIG. 5C, the second outlet 124 is disposed to communicate with the connecting channel 12 and is a third end of the connecting channel 12; the second outlet 124 is disposed on the upper surface 1131 of one of the blades 113 and is close to the first outlet 123. The connecting channel 12 continues to extend from the interior of the blade 113 corresponding to the first outlet 123 to the upper surface 1131 of the blade 113 corresponding to the second outlet 124 and then communicates with the second outlet 124. By means of two outlets (i.e., the first outlet 123 and the second outlet 124) individually disposed at different locations on the upper surface 1131 of the corresponding blade 113, the eddy noises generated at different locations on the upper surface 1131 of the blade 113 can be effectively restricted by the jets to reduce the noises. In another embodiment, referring to FIG. 5D, the first outlet 123 is disposed on an upper surface 1131 of one of the blades 113; the second outlet 124 is disposed on the sidewall 1112 above the upper surface 1131 of one of the blades 113 and is corresponding to the first outlet 123 on the upper surface 1131 of the corresponding blade 113. By means of the design of two outlets individually disposed on the upper surface 1131 of the corresponding blade 113 and disposed on the sidewall 1112 in the low-pressure zone, the eddies above the surfaces of the blades 113 and the eddies around the corner between the sidewall 1112 and the corresponding blade 113 can be restricted to achieve the effect of multi-eddies reduction to reduce noise significantly.

In another embodiment, referring to FIG. 5E, the first outlet 123 is disposed on the side edge 1135 of one of the blades 113; the second outlet 124 is disposed on the sidewall 1112 above the upper surface 1131 of one of the blades 113 and the connecting channel 12 extends upwards from the first inlet 121 along and inside the sidewall 1112 to the first outlet 123 on side edge 1135 of the blade 113 through the interior of the blade 113. By means of the design of two outlets (i.e., the first outlet 123 and the second outlet 124) individually disposed on the side edge 1135 of the corresponding blade 113 and disposed on the sidewall 1112 in the low-pressure zone, the eddies around the side edge 1135 of the blade 113 and the eddies around the corner between the sidewall 1112 and the corresponding blade 113 can be restricted to achieve the effect of multi-eddies reduction to reduce noise significantly.

In another embodiment, referring to FIGS. 6A and 6B, the first outlet 123 is disposed on the rear edge 1134 of one of the blades 113; a second inlet 122 is disposed to communicate with the connecting channel 12 and is a third end of the connecting channel 12. The first inlet 121 and the second inlet 122 are individually disposed on the sidewall 1112 below the low surface 1132 of one of the blades 113; the first inlet 121 disposed in the high-pressure zone is next to the second inlet 122. Because of the high pressure at the first outlet 123 on the rear edge 1134, the inlet pressure can be increased by arranging plural inlets (e.g., the first and the second inlets) such that a pressure difference naturally occurs in the connecting channel 12. Consequently, due to the pressure difference, the air flows 3 individually directed into the first inlet and the second inlet and inside the connecting channel 12 will naturally flow to the first outlet 123 on the rear edge 1134 of the blade 113 and spurts out. In this way, the eddies around the rear edge 1134 of the blade 113 can be restricted to reduce noise.

The shapes of the first outlet 123, the second outlet 124, the first inlet 121, the second inlet 122, and the interior of the connecting channel 12 in the previous variants of the second embodiment are the same as those of the first outlet 123, the second outlet 124, the first inlet 121, the second inlet 122, and the interior of the connecting channel 12 in the first embodiment and will not be repeated.

In alternative embodiment, the at least one connecting channel 12 is plural in number. The connecting channels 12 extend from the sidewall 1112 of the hub 111 to the corresponding blade 113 along the edge of the hub 111 axially or radially. Besides, the connecting channels 12 can be disposed with axial symmetry between the sidewall 1112 and the corresponding blades 113. In this way, the same eddy noises can be further restricted. Alternatively, the connecting channels 12 can be disposed without axial symmetry between the sidewall 1112 and the corresponding blades 113. In this way, the different eddy noises can be effectively restricted.

What is claimed is:

1. A jet structure of a fan rotor, comprising:

a fan wheel having a hub and a plurality of blades disposed on a circumferential side of the hub, wherein the hub has a top portion and a sidewall axially extending from an edge of the top portion, wherein each of the plurality of blades has an upper surface and a lower surface which form a low-pressure zone and a high-pressure zone, respectively; and at least one connecting channel disposed in the sidewall of the hub and provided with at least one first inlet disposed in the high-pressure zone and at least one first outlet disposed in the low-pressure zone, wherein the at least one first inlet and the at least one first outlet are a first end and a second end of the at least one connecting channel, respectively, the at least one first outlet is disposed on the sidewall above the upper surface of one of the plurality of blades and the at least one first inlet is disposed on the sidewall below the lower surface of the one of the plurality of blades.

2. The jet structure of the fan rotor according to claim 1, wherein the at least one first outlet is disposed above a junction of the sidewall and a side of the one of the plurality of blades.

* * * * *